US010948174B1

(12) United States Patent
Zhang

(10) Patent No.: US 10,948,174 B1
(45) Date of Patent: Mar. 16, 2021

(54) WATERPROOF LAMP DECORATION

(71) Applicant: Gemmy Industries Corporation, Coppell, TX (US)

(72) Inventor: Cheng-Chun Zhang, Shenzhen (CN)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 16/679,370

(22) Filed: Nov. 11, 2019

(51) Int. Cl.

| | |
|---|---|
| ***F21S 4/00*** | (2016.01) |
| ***F21V 31/00*** | (2006.01) |
| ***F21V 15/01*** | (2006.01) |
| ***F21V 23/00*** | (2015.01) |
| *F21V 23/06* | (2006.01) |
| *F21Y 115/10* | (2016.01) |

(52) U.S. Cl.
CPC ..... *F21V 31/005* (2013.01); *F21V 15/01* (2013.01); *F21V 23/001* (2013.01); *F21V 23/06* (2013.01); *F21Y 2115/10* (2016.08)

(58) Field of Classification Search
CPC ..... F21V 31/005
See application file for complete search history.

(56) References Cited

U.S. PATENT DOCUMENTS 3,355,612 A * 11/1967 Peek, Jr. ..... F21V 29/83 313/35
5,626,415 A * 5/1997 Huang ..... F21V 3/00 362/267
5,667,296 A * 9/1997 Cheng ..... F21V 31/00 362/267
6,238,062 B1 * 5/2001 Hsu ..... F21V 19/006 362/267
6,382,812 B1 * 5/2002 Hsu ..... F21V 19/006 362/249.07
6,796,688 B2 * 9/2004 Huang ..... F21V 19/0005 313/623
7,217,005 B2 * 5/2007 Lin ..... F21S 4/10 362/249.02
7,762,710 B2 * 7/2010 Chang ..... F21V 3/04 362/363
7,883,261 B2 * 2/2011 Yu ..... F21V 17/06 362/249.02
8,376,606 B2 * 2/2013 Yu ..... F21V 17/06 362/652

(Continued)

*Primary Examiner* — Andrew J Coughlin
(74) *Attorney, Agent, or Firm* — Alan D. Kamrath; Karin L. Williams; Mayer & Williams PC

(57) ABSTRACT

A waterproof lamp decoration has a lamp unit having a waterproof illumination unit and a lamp cover detachably engaged with the waterproof illumination unit. The waterproof illumination unit has a transparent shell, an end cap, a lamp board, multiple conducting wires, and an encapsulating body. The lamp board is mounted in a chamber formed between the transparent shell and the end cap. The conducting wires are mounted through the end cap from the chamber. The encapsulating body joins and surrounds a connecting portion of the transparent shell, the end cap, and the conducting wires and seals gaps formed among them to seal the chamber, and to prevent moisture from entering the chamber, so as to ensure the waterproof effect of the waterproof illumination. The lamp cover is changeable to enhance variability of illumination and decorativeness of the waterproof lamp decoration.

14 Claims, 10 Drawing Sheets

(56) References Cited

U.S. PATENT DOCUMENTS

| | | | | |
|---|---|---|---|---|
| 2004/0264187 | A1* | 12/2004 | Vanderschuit | H05B 47/10 362/235 |
| 2005/0086801 | A1* | 4/2005 | Liu | H01R 25/16 29/854 |
| 2008/0143234 | A1* | 6/2008 | Yu | F21S 4/10 313/318.08 |
| 2009/0080195 | A1* | 3/2009 | Huang | H01R 33/965 362/267 |
| 2009/0129099 | A1* | 5/2009 | Fan | F21S 4/10 362/368 |
| 2013/0027940 | A1* | 1/2013 | Zhang | F21S 4/10 362/249.06 |
| 2013/0051079 | A1* | 2/2013 | Xu | F21V 17/14 362/640 |
| 2014/0126219 | A1* | 5/2014 | Fan | F21S 4/10 362/311.02 |
| 2016/0010814 | A1* | 1/2016 | Peng | F21S 4/10 362/244 |
| 2019/0353309 | A1* | 11/2019 | Yu | F21V 21/0832 |

* cited by examiner

WATERPROOF LAMP DECORATION

BACKGROUND OF THE INVENTION

1. Field of the Invention

The present invention relates to a lamp decoration, and more particularly to a lamp decoration, which is waterproof and has a changeable lamp cover.

2. Description of Related Art

A conventional lamp decoration is applied for decorating various indoor and outdoor places. A conventional lamp decoration substantially has a lamp unit or multiple lamp units serially connected to compose a light string. The illumination effects performed by the lamp decoration are applied for attracting participants' attention and creating a festive atmosphere. Therefore, how to improve the lighting variations and decorativeness is the focus of improvement for the lamp decoration products.

The conventional lamp unit substantially has a lamp board, a lamp cover, and a cap. The lamp board is mounted in the lamp cover, and light emitted by the lamp board is transmitted through the lamp cover to produce illumination effects. The cap covers an opening of the lamp cover and has through holes for conducting wires to be mounted throughout the cap. Lamp decorations are usually put on trees and streets outdoors. When snowing or raining, snow water or rain may flow into the through holes of the cap via the conducting wires. In addition, moisture may enter the lamp cover via gaps formed between the lamp cover and the cap to damage electrical units of the lamp board. The life of the lamp decoration would be shortened.

To overcome the shortcomings, the present invention tends to provide a waterproof lamp decoration to mitigate or obviate the aforementioned problems.

SUMMARY OF THE INVENTION

The main objective of the invention is to provide a lamp decoration which is waterproof and has an interchangeable lamp cover.

A waterproof lamp decoration has a lamp unit having a waterproof illumination unit and a lamp cover. The waterproof illumination unit has a transparent shell, an end cap, a lamp board, multiple conducting wires, an encapsulating body, and an engaging portion. The transparent shell has an opening formed in an end of the transparent shell. The end cap covers the opening of the transparent shell to form a chamber between the transparent shell and the end cap. The end cap has multiple through holes communicating with the chamber. The lamp board is mounted in the chamber and has multiple light-emitting diodes (LEDs). The conducting wires are electrically connected with the lamp board and mounted through the through holes of the end cap. The encapsulating body joins and surrounds a connecting portion of the transparent shell, the end cap, and the conducting wires by injection molding and seals gaps formed among the transparent shell, the end cap, and the conducting wires to seal the chamber. The engaging portion is formed in an end of the encapsulating body near the transparent shell. The lamp cover is detachably connected with the engaging portion and surrounds the transparent shell.

Other objects, advantages and novel features of the invention will become more apparent from the following detailed description when taken in conjunction with the accompanying drawings.

DETAILED DESCRIPTION OF PREFERRED EMBODIMENT

Figure 1:
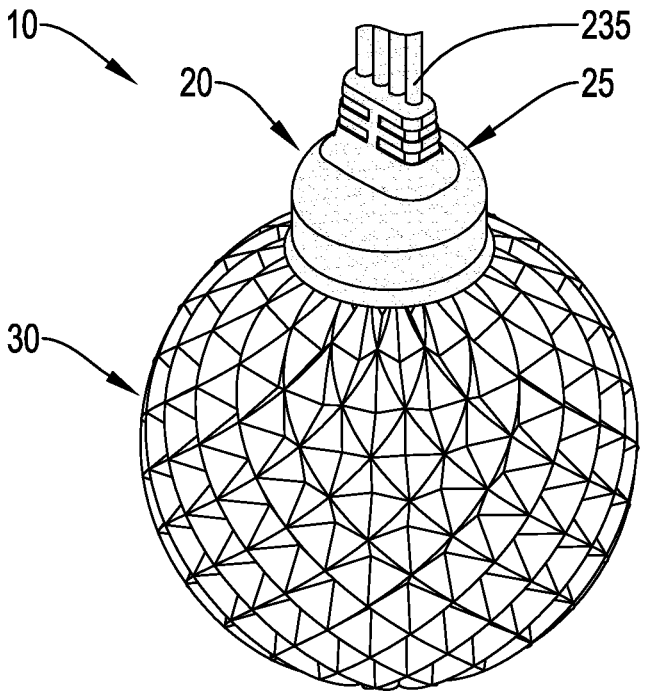
FIG. 1 is a perspective view of a first embodiment of a waterproof lamp decoration in accordance with the present invention.
Figure 2:
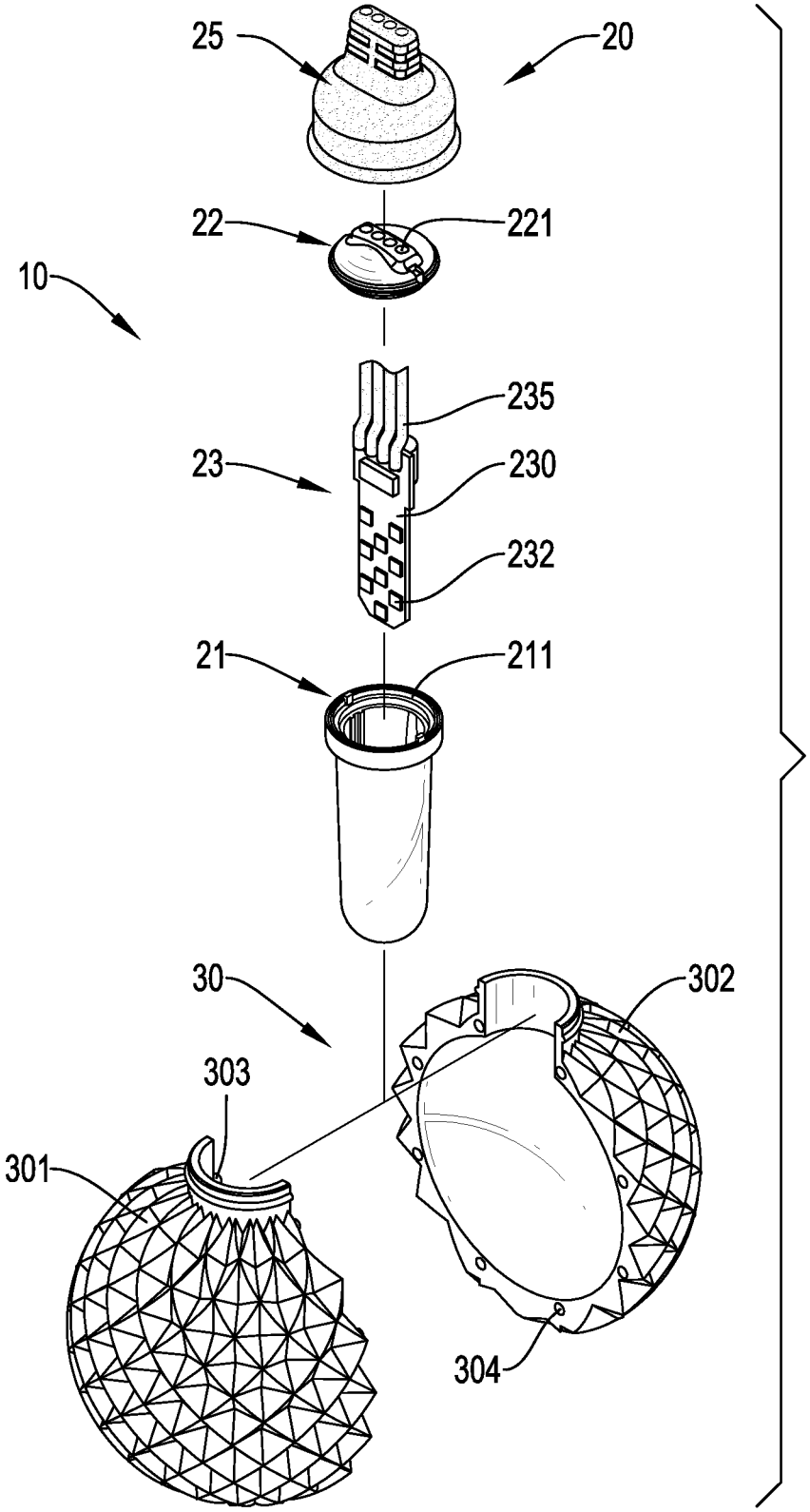
FIG. 2 is an exploded perspective view of the waterproof lamp decoration in FIG. 1.
Figure 3B:
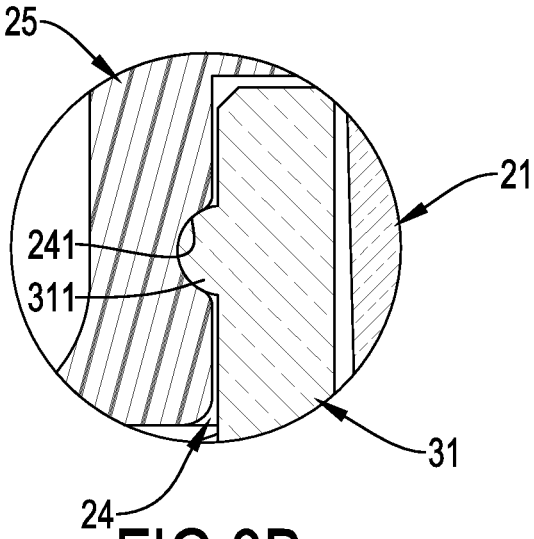
FIG. 3B is an enlarged cross sectional side view of the waterproof lamp decoration in FIG. 3A.
Figure 3A:
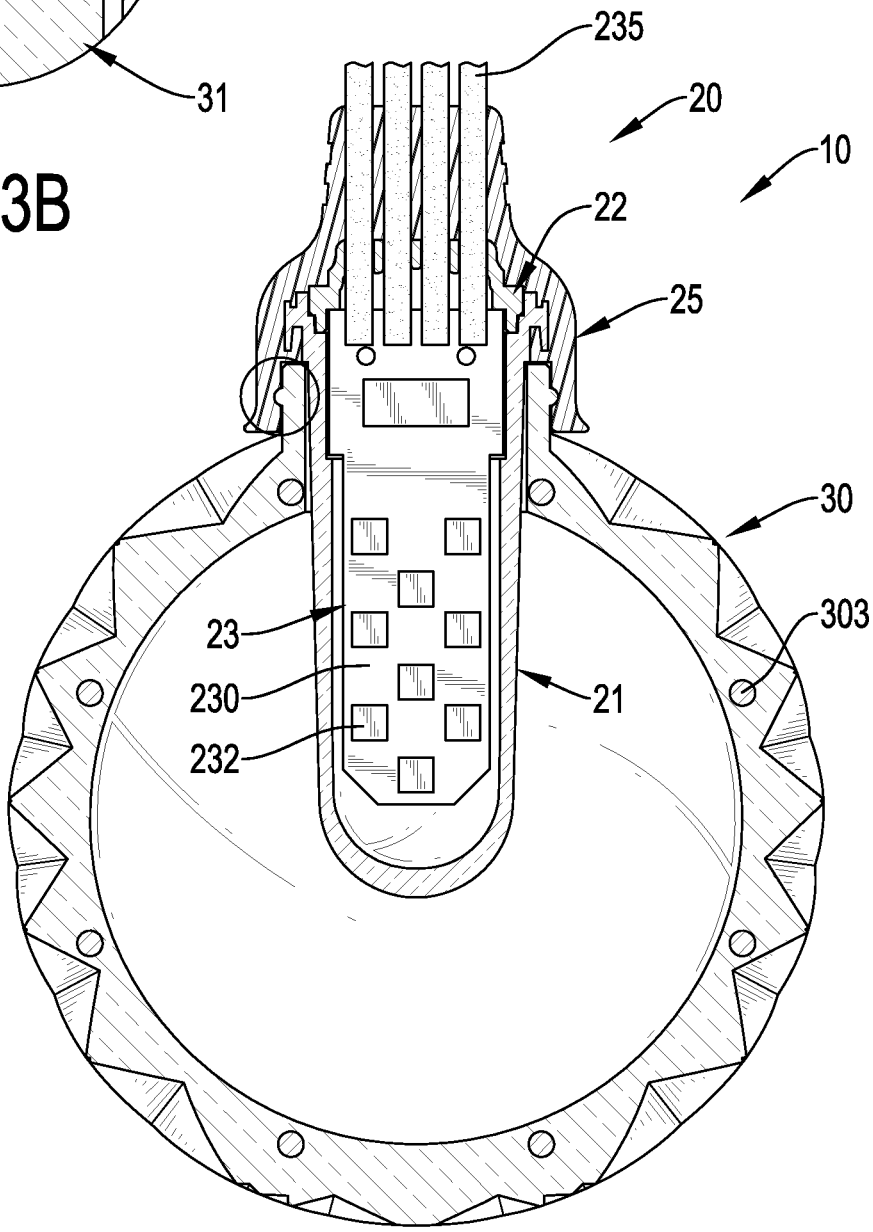
FIG. 3A is a cross sectional side view of the waterproof lamp decoration in FIG. 1.

With reference to FIGS. 1 to 3, a first embodiment of a waterproof lamp decoration in accordance with the present invention has a lamp unit 10. The lamp unit 10 has a waterproof illumination unit 20 and a lamp cover 30.

Figure 5:
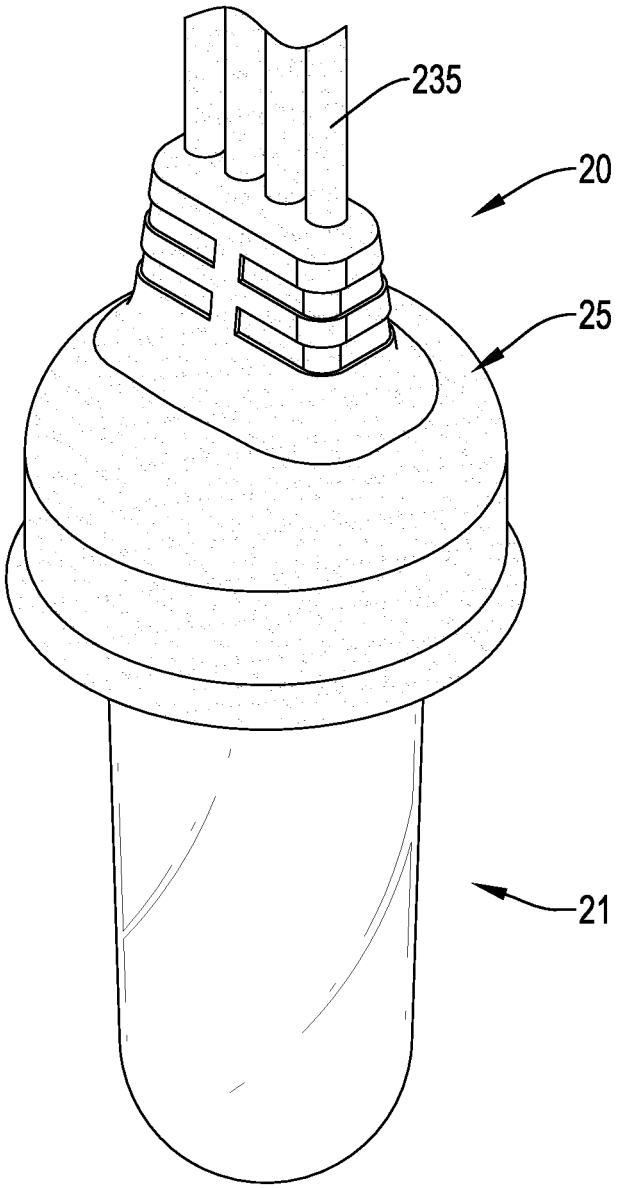
FIG. 5 is an enlarged perspective view of the waterproof illumination unit in FIG. 4.
Figure 7:
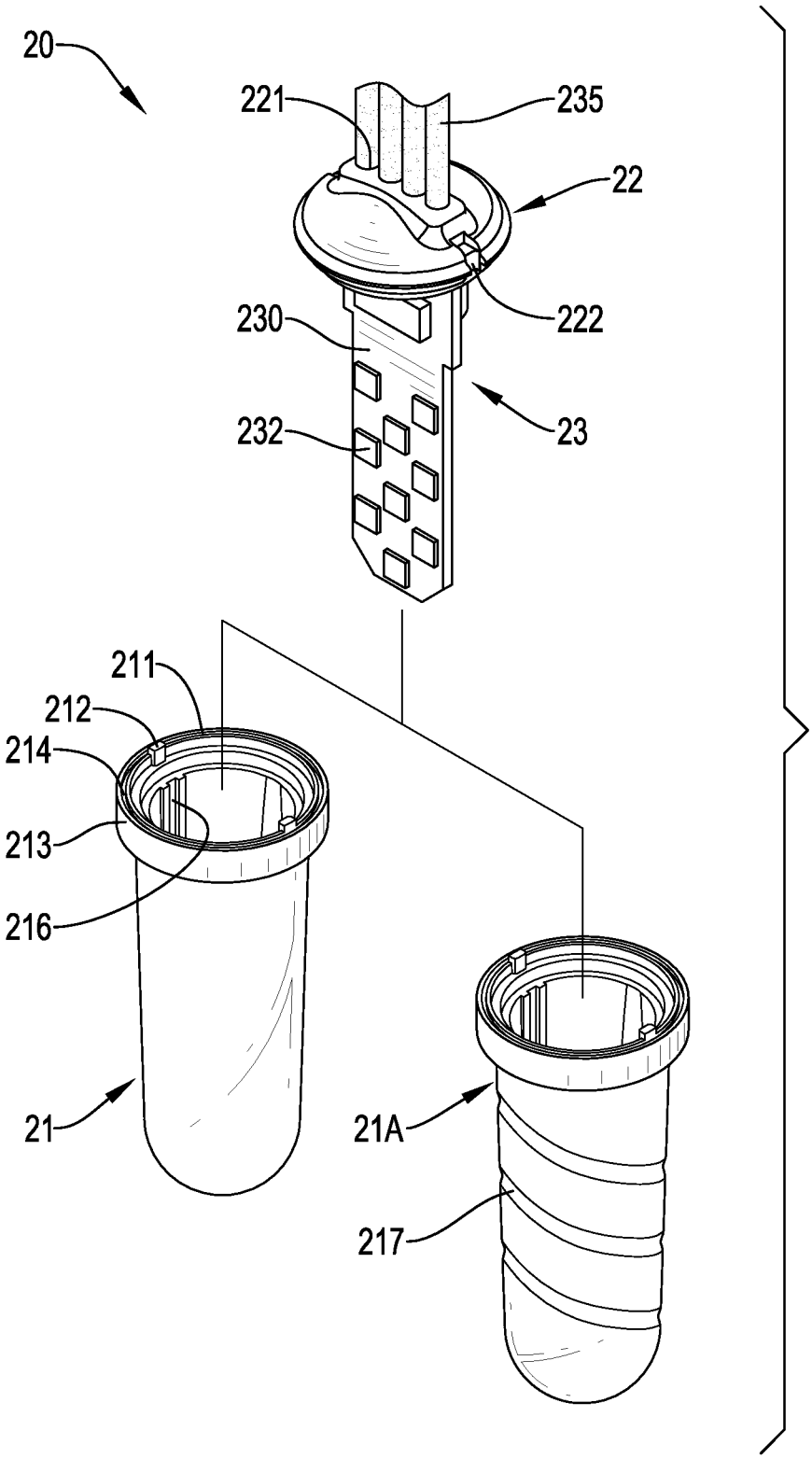
FIG. 7 is an exploded perspective view of the waterproof illumination unit in FIG. 5, showing two selectable transparent shells.

With reference to FIGS. 2, 5, and 7, the waterproof illumination unit 20 has a transparent shell 21, an end cap 22, a lamp board 23, multiple conducting wires 235, an encapsulating body 25, and an engaging portion 24.

The transparent shell 21 has an opening 211 formed in an end thereof. The end cap 22 is mounted in and covers the opening 211 of the transparent shell 21 to form a chamber 215 between the transparent shell 21 and the end cap 22. The end cap 22 has multiple through holes 221 communicating with the chamber 215. The transparent shell 21 and the end cap 22 may each have a respective fixing structure 212, 222 formed therebetween. The fixing structures 212, 222 may be protrusions and recesses respectively corresponding to each other in position to fix the assembling position of the end cap 22.

The lamp board 23 is mounted in the chamber 215, and has a board 230 and multiple light-emitting diodes (LEDs) 232. The board 230 may be a printed circuit board. The LEDs 232 are mounted on the board 230 and are arranged at spaced intervals. The conducting wires 235 are mounted through the through holes 221 of the end cap 22 and are electrically connected with the lamp board 23. Preferably, the transparent shell 21 may further have a board positioning portion 216 formed therein. The lamp board 23 can be fixed in the board positioning portion 216.

The material of the encapsulating body 25 may be selected from a plastic material having low degree of hardness and being flexible, such as soft polyvinylchloride (PVC). The encapsulating body 25 joins and surrounds a connecting portion of the end cap 22, the transparent shell 21, and the conducting wires 235 by injection molding, and seals gaps formed among the end cap 22, the transparent shell 21, and the conducting wires 235 to seal the chamber 215. The gaps abovementioned include gaps formed between the through holes 221 and the conducting wires 235, and gaps formed between the transparent shell 21 and the end cap 22. The encapsulating body 25 prevents moisture from entering the chamber 215 to negatively affect the electrical units of the lamp board 23, and the waterproof property of the waterproof illumination unit 20 is ensured. The light emitted by the lamp board 23 can be transmitted through the transparent shell 21. With reference to FIG. 7, the transparent shell 21, 21A may be selected from a transparent shell 21 having no patterns formed on an outer surface thereof, or a transparent shell 21A having patterns 217 formed on an outer surface thereof. When the light emitted by the lamp board 23 is transmitted through the transparent shell 21 without patterns, or the transparent shell 21A with patterns 217, different illumination effects may be provided.

Figure 6:
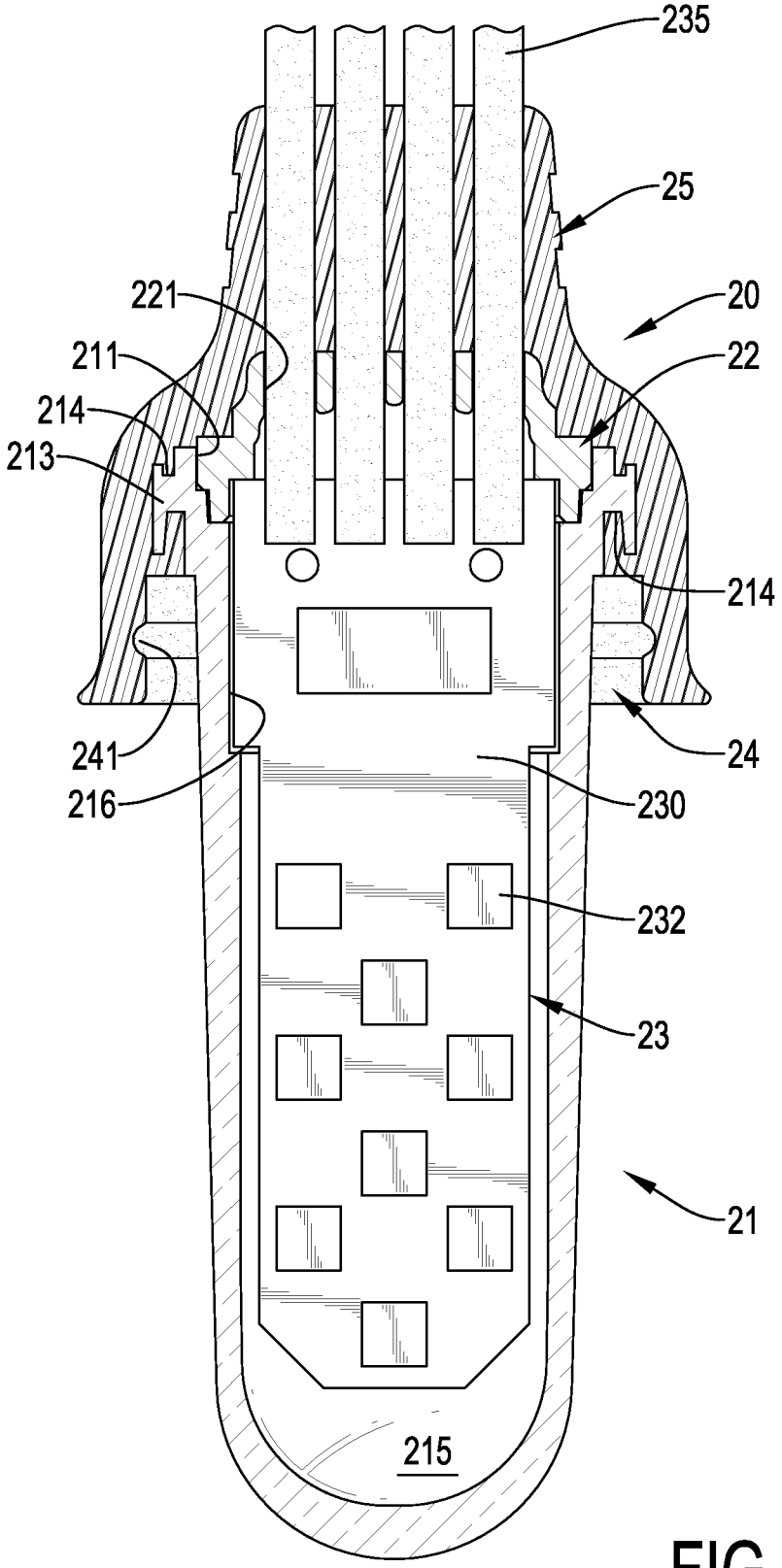
FIG. 6 is a cross sectional side view of the waterproof illumination unit in FIG. 5.

With reference to FIGS. 2, 3, and 6, the engaging portion 24 is formed in the encapsulating body 25 at an end near the transparent shell 21, and is applied for connecting with the lamp cover 30. In the embodiment, the engaging portion 24 comprises an engagement cavity formed between the encapsulating body 25 and the transparent shell 21. The engagement cavity has a groove 241 radially formed in the encapsulating body 25.

The manufacturing process of the waterproof illumination unit 20 is as follows. After the lamp board 23, the conducting wires 235, the end cap 22, and the transparent shell 21 are assembled, the assembly is placed into a plastic injection mold to process injection molding. The material of the encapsulating body 25 is injected into the mold cavity, fills up the mold cavity, and joins and surrounds the connecting portion of the end cap 22, the transparent shell 21, and the conducting wires 235 to form the encapsulating body 25. Thus, the encapsulating body 25 can seal the gaps formed among the end cap 22, the transparent shell 21, and the conducting wires 235. The waterproof illumination unit 20 is tightly sealed for waterproof function, and can prevent moisture from entering the chamber 215 via the gaps formed among the end cap 22, the transparent shell 21, and the conducting wires 235 and negatively affecting the electrical units of the lamp board 23.

With reference FIGS. 3 and 7, preferably, the transparent shell 21 has at least one bonding groove 214 formed in the outer surface thereof, and the encapsulating body 25 is filled in the bonding groove 214 to enhance the joining strength of the transparent shell 21 and the encapsulating body 25, to prevent the encapsulating body 25 from being easily separated from the transparent shell 21, and to ensure the sealing of the waterproof illumination unit 20. In the embodiment, the transparent shell 21 has a flange 213 protruding from the outer surface thereof at a position near the end cap 22. An annular bonding groove 214 is recessed in each of opposite ends of the flange 213, which are facing and away from the end cap 22. The encapsulating body 25 is filled in the bonding grooves 214. The bonding grooves 214 recessed in the end of the flange 213 away from the end cap 22 are engaged with the encapsulating body 25 as a hooking structure to further prevent the encapsulating body 25 from being easily separated from the transparent shell 21.

With reference to FIGS. 2 and 3, the lamp cover 30 surrounds the transparent shell 21 and is detachably connected with the engaging portion 24. The lamp cover 30 has a neck 31 protruding therefrom. An opening is formed in a top of the neck 31. An engaging protrusion 311 radially protrudes from an outer surface of the neck 31 and is mounted in the groove 241 to engage the neck 31 of the lamp cover 30 with the engagement cavity of the engaging portion 24.

In the embodiment, the lamp cover 30 is ball-shaped. The lamp cover 30 is composed of two hemispherical shells 301, 302. The shells 301, 302 each have a respective embedded structure 303, 304 formed thereon and the two embedded structures 303, 304 correspond to each other in position. The lamp cover 30 has multiple facets recessed in an outer surface thereof. The light transmitted through the waterproof illumination unit 20 may be refracted through the facets.

Figure 4:
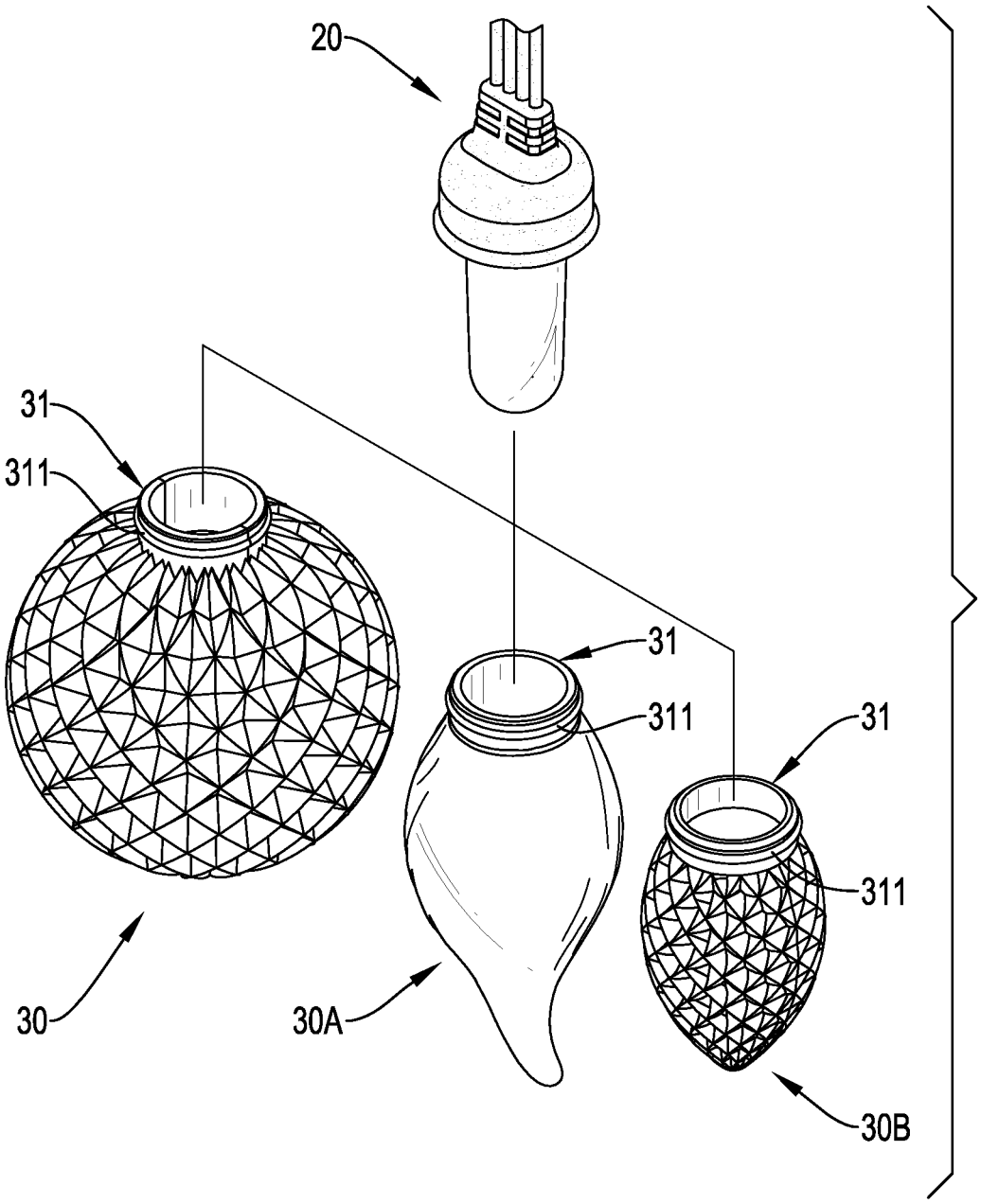
FIG. 4 is an exploded perspective view of the waterproof lamp decoration in FIG. 2, showing three selectable lamp covers.

With reference to FIG. 4, the shapes of the lamp cover 30, 30A, 30B may be various, e.g., a droplet-shaped lamp cover 30A, or a lamp cover 30B having a tip end. Each lamp cover 30, 30A, 30B has a neck 31 and an engaging protrusion 311 of the same size specification to be mounted in the same waterproof illumination unit 20. The lamp cover 30, 30A, 30B may have recesses, patterns, or facets on the outer surfaces thereof. When the lamp covers 30, 30A, 30B in different shapes coordinate with the transparent shell 21, 21A with or without patterns, different illumination effects may be produced.

Figure 8:
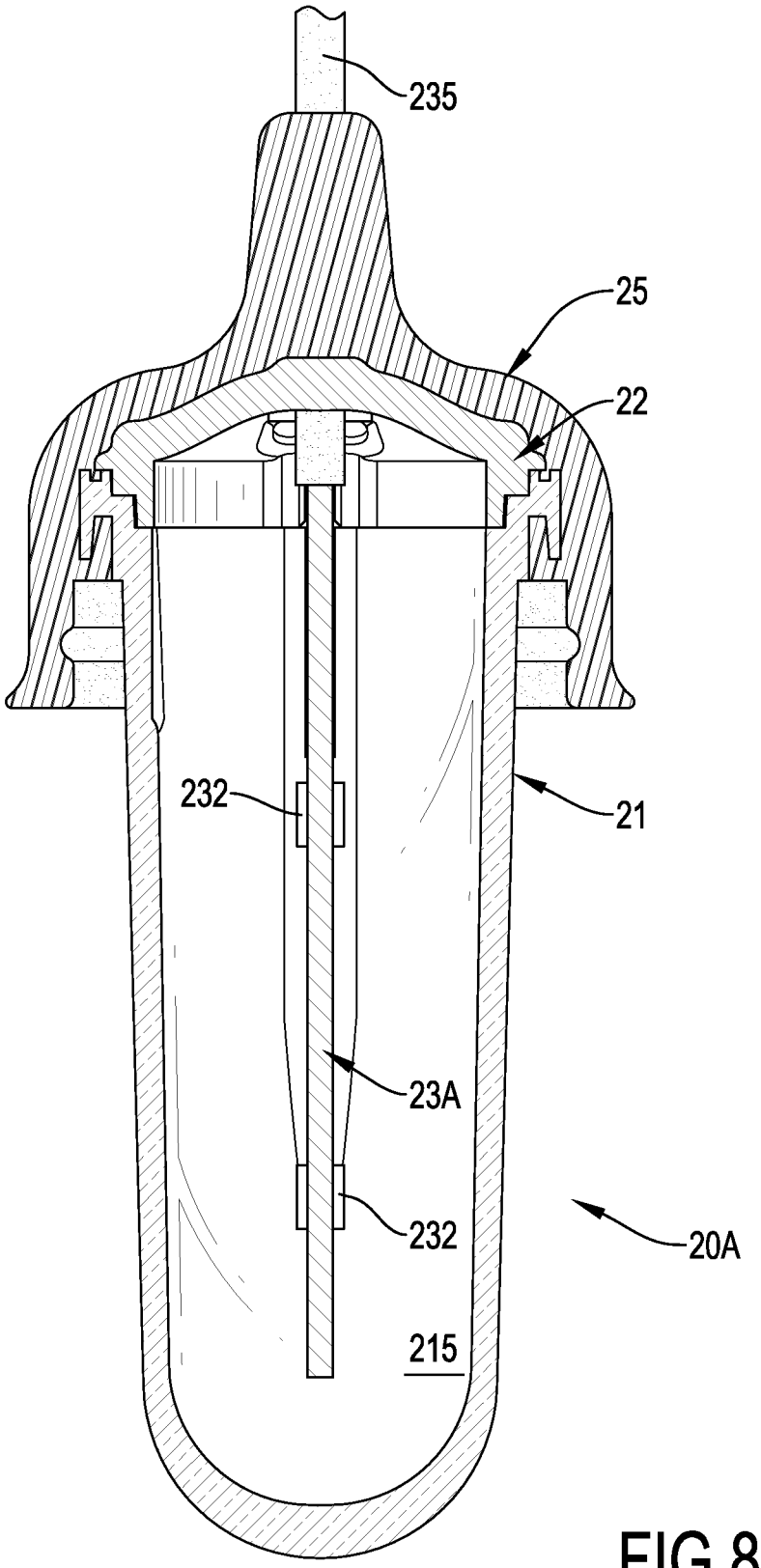
FIG. 8 is a cross sectional side view of a second embodiment of a waterproof illumination unit of a waterproof lamp decoration in accordance with the present invention.
Figure 9:
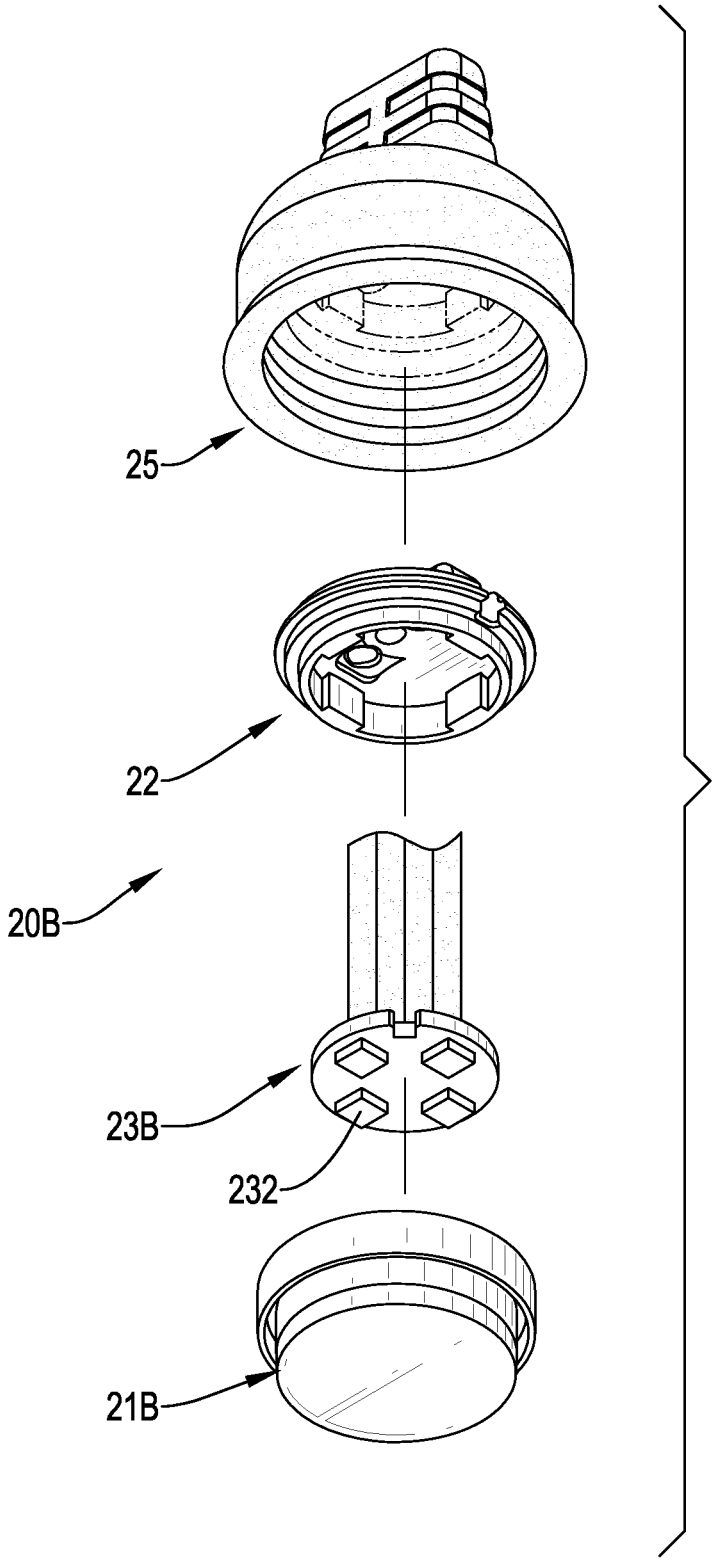
FIG. 9 is an exploded perspective view of a third embodiment of a waterproof illumination unit of a waterproof lamp decoration in accordance with the present invention.

With reference to FIG. 6, in the first embodiment, the LEDs 232 are mounted on a single side of the lamp board 23 at spaced intervals. The lamp board 23 extends away from the end cap 22. Thus, the waterproof illumination unit 20 is luminous at one side. With reference to FIG. 8, in the second embodiment, the LEDs 232 are respectively mounted on opposite sides of the lamp board 23A at spaced intervals. The lamp board 23A extends away from the end cap 22. Thus, the waterproof illumination unit 20A is luminous at opposite sides. With reference to FIG. 9, in the third embodiment, the LEDs 232 are mounted on the lamp board 23B at a position away from the end cap 22. The lamp board 23B is held between the end cap 22 and the transparent shell 21B. Thus, the waterproof illumination unit 20B is luminous at the bottom side. When the waterproof illumination units 20, 20A, 20B in different luminous sides coordinate with the transparent shell 21, 21A, and the lamp cover 30, 30A, 30B, different illumination effects may be produced to enhance variability of the illumination effects.

Figure 10:
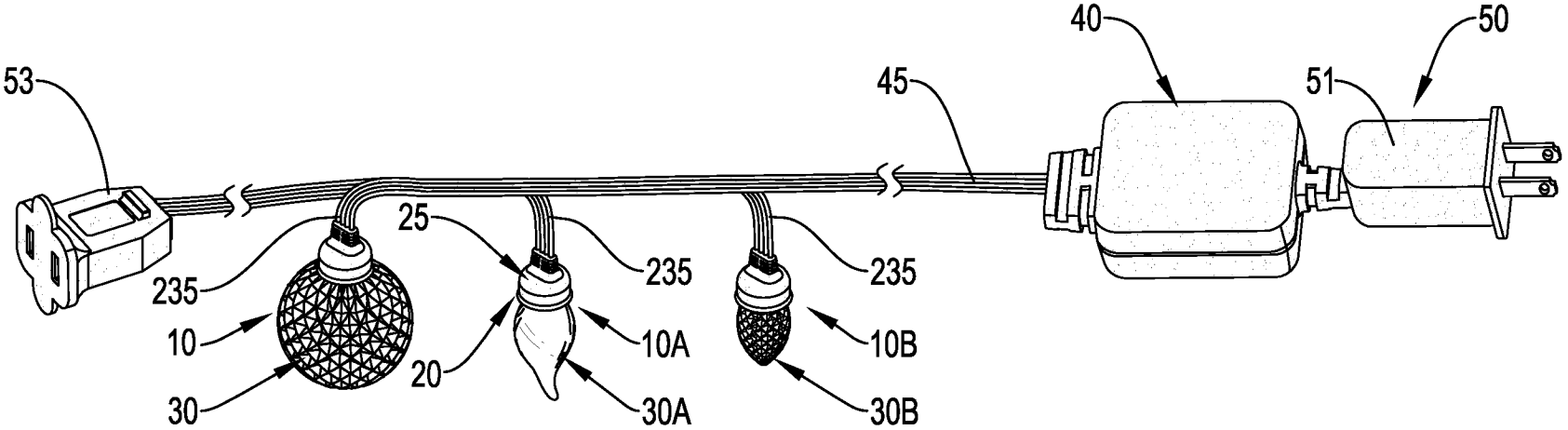
FIG. 10 is an operational perspective view of an embodiment of a waterproof lamp decoration in accordance with the present invention.

With reference to FIGS. 2 and 10, the waterproof lamp decoration has multiple lamp units 10, 10A, 10B, multiple electric wires 45, a controller 40, and a connector assembly 50. The conducting wires 235 of each lamp unit 10, 10A, 10B are electrically connected to the controller 40 via the electric wires 45. The controller 40 is electrically connected to the connector assembly 50 via the electric wires 45. The connector assembly 50 has a plug 51 and a socket 53. The plug 51 may be plugged in an electric supply socket, or in the socket 53 of another lamp decoration for series connecting the lamp decorations. The controller 40 is applied for controlling lighting colors and blink frequency of the LEDs 232 of the lamp boards 23 of the lamp units 10, 10A, 10B.

The shapes of the lamp covers 30, 30A, 30B of the lamp units 10, 10A, 10B can be selected by the user's requirements. A lamp decoration may have lamp covers 30, 30A, 30B in the same shape, or may have lamp covers 30, 30A, 30B in different shapes. The lamp covers 30, 30A, 30B are changeable. Thus, the lamp covers 30, 30A, 30B in different shapes may coordinate with the waterproof illumination units 20 to produce various illumination effects. The variability and decorativeness of the waterproof lamp decoration is enhanced.

The waterproof illumination unit 20 has the encapsulating body 25 surrounding and joining the connecting portion of the transparent shell 21, the end cap 22, and the conducting wires 235 and sealing the gaps formed among the transparent shell 21, the end cap 22, and the conducting wires 235 to seal the chamber 215. The structures of the waterproof illumination units 20 can prevent moisture from entering the chambers 215 and negatively influencing the electrical units of the lamp board 23, and the waterproof effect of the waterproof lamp decoration can be ensured.

Moreover, the lamp cover 30 is changeable. The waterproof illumination unit 20 can coordinate with different lamp covers 30, 30A, 30B in different shapes to provide different illumination effects. The variability and decorativeness of the waterproof lamp decoration is enhanced.

What is claimed is:

1. A waterproof lamp decoration comprising:

a lamp unit having a waterproof illumination unit having a transparent shell having an opening formed in an end of the transparent shell;

an end cap covering the opening of the transparent shell to form a chamber between the transparent shell and the end cap, and the end cap having multiple through holes communicating with the chamber;

a lamp board mounted in the chamber and having multiple light-emitting diodes (LEDs);

multiple conducting wires electrically connected with the lamp board and mounted through the through holes of the end cap;

an encapsulating body joining and surrounding a connecting portion of the transparent shell, the end cap, and the conducting wires by injection molding and sealing gaps formed among the transparent shell, the end cap, and the conducting wires to seal the chamber; and an engaging portion formed in an end of the encapsulating body near the transparent shell; and a lamp cover detachably connected with the engaging portion and surrounding the transparent shell;

wherein the transparent shell has a flange protruding from an outer surface of the transparent shell at a position near the end cap; and at least one bonding groove formed in the outer surface of the transparent shell; and the encapsulating body is filled in the at least one bonding groove of the transparent shell, wherein one of the at least one bonding groove is recessed in an end of the flange away from the end cap and engages with the encapsulating body as a hooking structure.

2. The waterproof lamp decoration as claimed in claim 1, wherein the engaging portion comprises an engagement cavity formed between the transparent shell and the encapsulating body; and the lamp cover has a neck protruding from the lamp cover and having an opening formed in a top of the neck, and the neck is engaged with the engagement cavity of the engaging portion.

3. The waterproof lamp decoration as claimed in claim 2, wherein the LEDs are mounted on one side of the lamp board, and the lamp board extends away from the end cap.

4. The waterproof lamp decoration as claimed in claim 3, wherein the waterproof lamp decoration comprises multiple said lamp units, multiple electric wires, a controller, and a connector assembly, and the conducting wires of each lamp unit, the controller, and the connector assembly are electrically connected via the electric wires.

5. The waterproof lamp decoration as claimed in claim 2, wherein the LEDs are respectively mounted on opposite sides of the lamp board, and the lamp board extends away from the end cap.

6. The waterproof lamp decoration as claimed in claim 5, wherein the waterproof lamp decoration comprises multiple said lamp units, multiple electric wires, a controller, and a connector assembly, and the conducting wires of each lamp unit, the controller, and the connector assembly are electrically connected via the electric wires.

7. The waterproof lamp decoration as claimed in claim 2, wherein the LEDs are mounted on the lamp board at a position away from the end cap.

8. The waterproof lamp decoration as claimed in claim 7, wherein the waterproof lamp decoration comprises multiple said lamp units, multiple electric wires, a controller, and a connector assembly, and the conducting wires of each lamp unit, the controller, and the connector assembly are electrically connected via the electric wires.

9. The waterproof lamp decoration as claimed in claim 2, wherein the outer surface of the transparent shell is patternless.

10. The waterproof lamp decoration as claimed in claim 9, wherein the waterproof lamp decoration comprises multiple said lamp units, multiple electric wires, a controller, and a connector assembly, and the conducting wires of each lamp unit, the controller, and the connector assembly are electrically connected via the electric wires.

11. The waterproof lamp decoration as claimed in claim 2, wherein the transparent shell has patterns formed on the outer surface of the transparent shell.

12. The waterproof lamp decoration as claimed in claim 11, wherein the waterproof lamp decoration comprises multiple said lamp units, multiple electric wires, a controller, and a connector assembly, and the conducting wires of each lamp unit, the controller, and the connector assembly are electrically connected via the electric wires.

13. The waterproof lamp decoration as claimed in claim 2, wherein the waterproof lamp decoration comprises multiple said lamp units, multiple electric wires, a controller, and a connector assembly, and the conducting wires of each lamp unit, the controller, and the connector assembly are electrically connected via the electric wires.

14. The waterproof lamp decoration as claimed in claim 1, wherein the waterproof lamp decoration comprises multiple said lamp units, multiple electric wires, a controller, and a connector assembly, and the conducting wires of each lamp unit, the controller, and the connector assembly are electrically connected via the electric wires.

* * * * *